United States Patent [19]

Mork

[11] 4,418,759

[45] Dec. 6, 1983

[54] SOIL LEVELING APPARATUS

[76] Inventor: Orlan H. Mork, 6029 225th St. West, Farmington, Minn. 55024

[21] Appl. No.: 297,133

[22] Filed: Aug. 28, 1981

Related U.S. Application Data

[63] Continuation-in-part of Ser. No. 224,458, Jan. 12, 1981.

[51] Int. Cl.[3] ..... E02F 3/64

[52] U.S. Cl. ..... 172/197; 172/445

[58] Field of Search ..... 172/197, 445.1, 445.2, 172/684.5, 699.5, 785, 701.1, 701.3, 464

[56] References Cited

U.S. PATENT DOCUMENTS

| | | | |
|---|---|---|---|
| 1,833,878 | 11/1931 | Adams | 404/118 |
| 2,302,702 | 11/1942 | Leschinsky | 172/197 |
| 2,762,140 | 9/1956 | Elfes | 172/445.2 |
| 2,817,203 | 12/1957 | Sievers | 172/684.5 |
| 3,122,209 | 2/1964 | Crites | 172/197 X |
| 3,324,955 | 6/1967 | Perold | 172/197 X |
| 3,430,703 | 3/1969 | Richey | 172/197 |
| 3,556,228 | 1/1971 | Mork . | |
| 3,724,557 | 4/1973 | Boschung | 172/785 |
| 3,834,465 | 9/1974 | Collins | 172/197 |
| 3,904,380 | 9/1975 | Smith | 52/732 |
| 4,196,778 | 4/1980 | Smith | 172/445.1 |
| 4,217,962 | 8/1980 | Schaefer | 172/197 |

FOREIGN PATENT DOCUMENTS

| | | | |
|---|---|---|---|
| 1074994 | 4/1980 | Canada | 172/197 |
| 813809 | 5/1959 | United Kingdom | 172/445.1 |
| 849677 | 9/1960 | United Kingdom | 172/445.1 |

OTHER PUBLICATIONS

Product Brochure for the Jacobsen Trap King II, (Undated).

*Primary Examiner*—Richard J. Johnson

*Attorney, Agent, or Firm*—Merchant, Gould, Smith, Edell, Welter & Schmidt

[57] ABSTRACT

A soil leveling apparatus (10) is disclosed which includes a frame (11) having ground-engaging members (12a, 12b, 12c, 13) disposed transverse to the direction of motion, side rail members (14, 15) in which the ends of the ground-engaging members are secured, and upstanding connecting means (20) for operatively attaching the apparatus (10) to the draft vehicle. A scarifying means (50) for breaking up and loosening the soil prior to the leveling operation can be mounted near the forwardmost area of the apparatus (10). The scarifying means (50) includes a cross-shaft (51), connector arms (52) for pivotally connecting the cross-shaft to the frame (11), scarifiers (55) extending downwardly from the cross-shaft and a hydraulic cylinder (61) for lowering and raising the scarifying means into and out of the soil. Another embodiment incorporates a scarifying means (50) having scarifiers (66) which maintain a constant orientation during lifting and lowering by a self-camming action.

20 Claims, 9 Drawing Figures

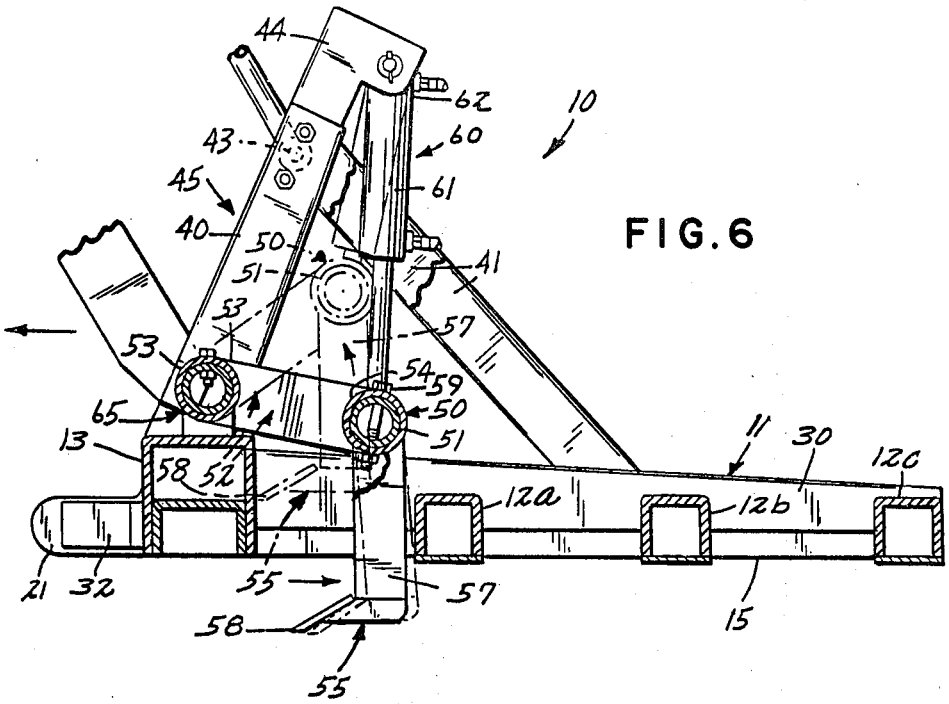
FIG. 6
FIG. 7
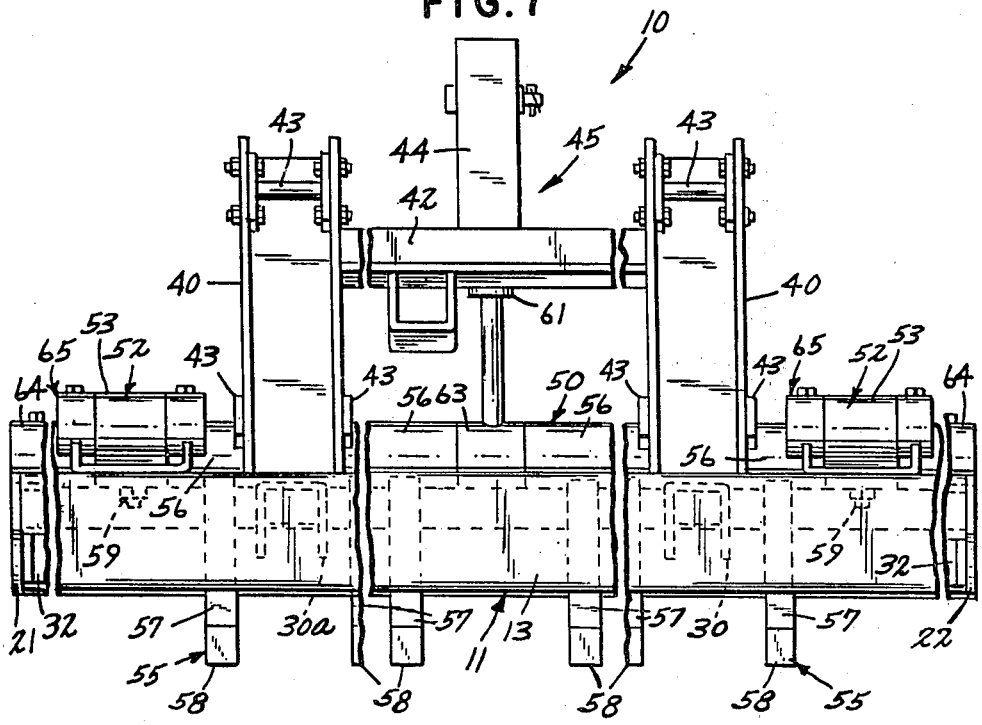

SOIL LEVELING APPARATUS

CROSS-REFERENCE TO RELATED APPLICATION

This is a continuation-in-part of co-pending application Ser. No. 224,458, filed Jan. 12, 1981.

TECHNICAL FIELD OF THE INVENTION

This invention relates to the field of leveling devices and specifically to apparatuses for leveling soil and like materials.

BACKGROUND OF THE INVENTION

The present invention is an improvement of my "Apparatus for Leveling Soil and the Like," U.S. Pat. No. 3,556,228, issued Jan. 19, 1971. The patented apparatus attaches to a three-point hitch draft vehicle which provides variation between the front end of the apparatus and the rear end of the apparatus relative to the surface of the soil. The apparatus can thereby accommodate large quantities of loose soil and yet effectively level the ground's surface.

SUMMARY OF THE INVENTION

The present invention, while continuing to offer the angle variation benefits of my earlier patent, provides new structure and advantages which will expand the art in this field. The improvements include the use of continuous side rail members instead of rectangular tubing having individual side plates. The side rails with their continuous construction virtually eliminate the undesirable ridge formations possible with the use of rectangular tubing and individual side plates. Further, the continuous side rail members with their open interior design and unique connections with the transverse ground-engaging members lessen soil buildup along the interior sides of the apparatus and allow the soil to be better carried along those sides to the rear end of the apparatus.

Another improvement includes the provision of a scarifying means for breaking up and loosening the soil immediately prior to the leveling action of the apparatus. As will be explained in the description below, the scarifiers provide soil disturbance in compacted, bumpy areas in order to effectively level the surface of that area. The scarifying means is constructed to withstand significant twisting forces and operating strains, and yet it is easily accessible for replacement of broken parts or adjustment of the distances between the scarifiers when desired.

Yet another improvement comprises a modification of the scarifiers such that each scarifier maintains a substantially constant angular relationship with the soil regardless of the selected penetration depth. In this modification, the rear edges of the scarifiers are formed to function as camming surfaces with an adjacent fixed transverse ground engaging member so that a substantially constant angular relationship is maintained over and between their extremes of vertical travel. The above improvements and other advantages will be further disclosed in the description which follows.

BRIEF DESCRIPTION OF THE DRAWINGS

FIG. 6 is a cross-sectional view of the embodiment shown in FIG. 5 as seen along Line 6—6 in FIG. 5;

FIG. 7 is a front elevational view of the second embodiment as viewed in a direction from left to right in FIG. 6, with portions broken away for illustration purposes;

DESCRIPTION OF THE PREFERRED EMBODIMENTS

Figure 1:
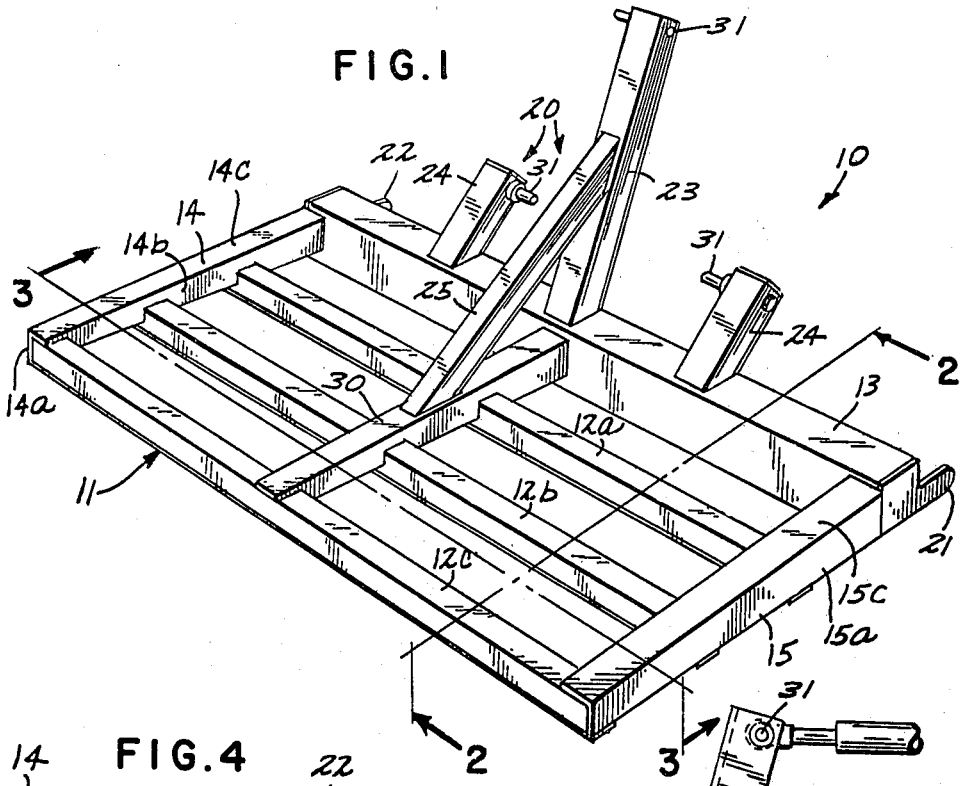
FIG. 1 is a perspective view of one embodiment of the present invention.

Referring now to the Drawings, wherein like reference numerals are used throughout the several views to indicate like elements of the invention, there is disclosed a soil leveling apparatus 10 having a frame structure 11, side rails 14, 15, and connecting means 20 for operatively connecting the apparatus 10 to a draft means such as a three-point hitch vehicle or a skid-steer vehicle. While connecting means 20 as illustrated is particularly adapted for use as a three-point hitch, it will be appreciated that frame 11 can be provided with any suitable connecting or hitch means depending upon the draft vehicle with which the soil leveling apparatus 10 is to be used.

Referring now to FIG. 1, the frame 11 includes a number of rectangular cross-sectional, elongated members positioned transverse to the direction of motion. In the preferred embodiment, the forwardmost cross member 13 of inverted, generally U-shaped, double channel construction is followed by three other ground-engaging members 12*a*, 12*b*, 12*c* having generally rectangular cross sections with closed bottoms. Member 13 preferably has a substantially larger cross-sectional area than the other ground-engaging members 12*a*, 12*b*, 12*c*, although it could be the same size, and member 13 will be hereinafter identified as the scraper member 13. The lower or bottom surfaces of the ground-engaging members 12*a*, 12*b*, 12*c* and scraper member 13 lie generally in the same plane.

Although apparatus 10 as illustrated incorporates a leading scraper member 13 of generally inverted channel construction, it will be understood that suitable scrapers of other configurations can be utilized without departing from the invention. For example, the scraper member 13 can comprise an H-beam section laid on its side or even a conventional moldboard blade, both of which are considered the full equivalent of the scraper member shown in the Drawings.

An elongated brace member 30 is connected to and extends generally along the top surfaces of the ground-engaging members 12*a*, 12*b*, 12*c* connecting at its forwardmost end with a central portion of the inner side surface of member 13. The brace member 30, as seen in FIG. 1, extends generally in the direction of motion and thus normal to the longitudinal axes of the ground-engaging members 12*a*, 12*b*, 12*c* and scraper member 13.

Fixedly attached to the frame 11 are a pair of side rail members 14, 15. Each side rail member has a continuous construction forming an elongated channel having two legs of unequal length and a top surface which preferably slopes downwardly from the forwardmost area of the apparatus near member 13. As can be seen in FIG. 1, the side rail members 14, 15 are connected to the frame 11 by securing the ends of the ground-engaging members 12*a*, 12*b*, 12*c* within the respective channels of the side rail members 14, 15. The forwardmost cross-sectional area of the side rail members 14, 15 are each secured, for example by welding, to a respective end portion of member 13.

Figure 3:
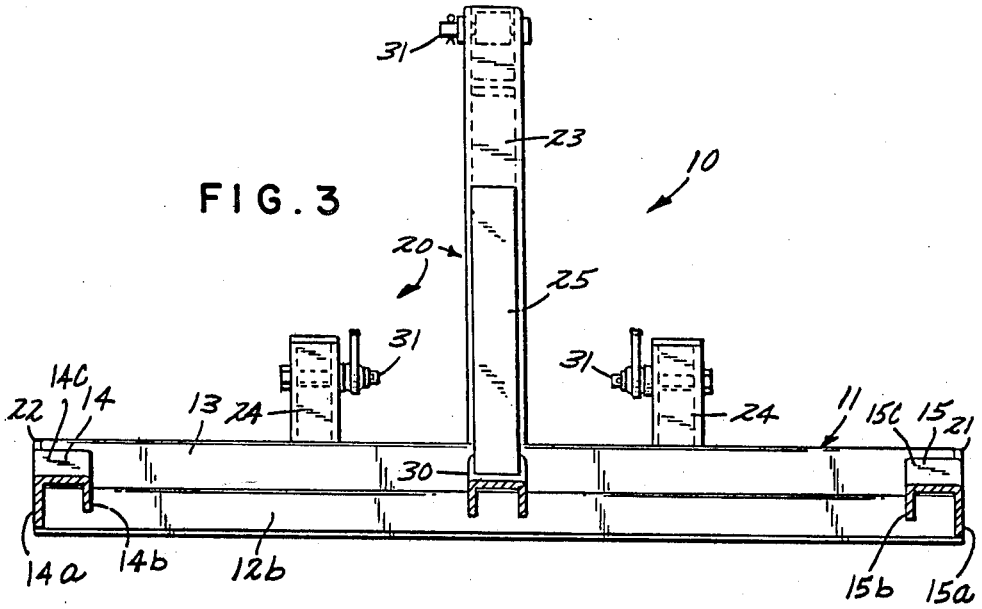
FIG. 3 is a cross-sectional view of the embodiment shown in FIG. 1 as seen along Line 3—3 in FIG. 1.

In the cross-sectional view of FIG. 3 the side rail members 14, 15 can be more clearly seen and understood. Each side rail member has a sloping top or upper surface 14*c*, 15*c*. Projecting downwardly from opposite edges of the top surfaces 14*c*, 15*c* are respective legs 14*a*, 14*b*, 15*a*, 15*b*, all of which have free edges, as can be seen in FIG. 3, which extend in the direction of motion generally parallel to the plane of the ground-engaging member lower surfaces. The outer legs 14*a*, 15*a* are significantly longer than the inner legs 14*b*, 15*b* in order to allow a better frame attachment to the two side rail members.

Figure 2:
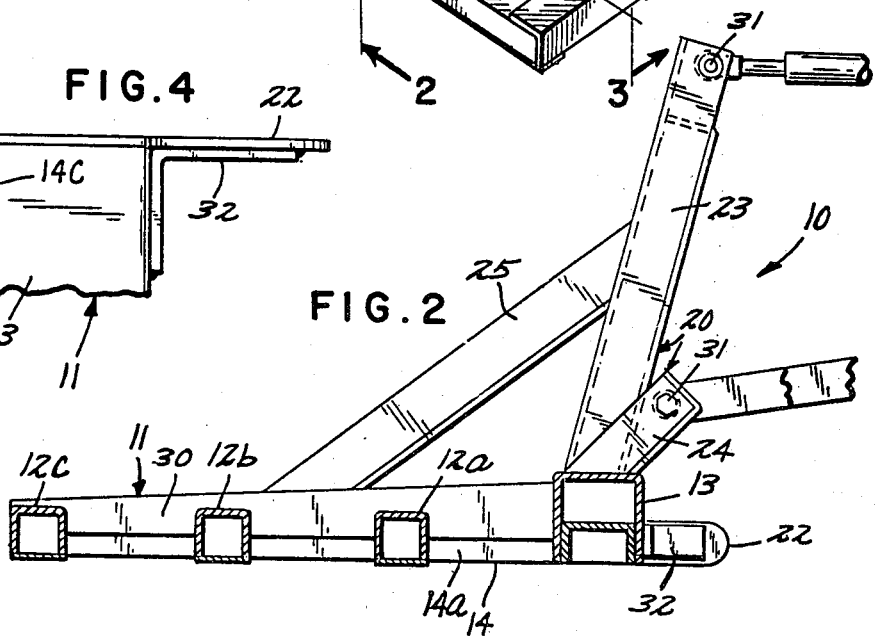
FIG. 2 is a cross-sectional view of the embodiment shown in FIG. 1 as seen along Line 2—2 in FIG. 1.

FIGS. 1, 2, and 3 when viewed together illustrate the improved means for attaching the frame's ground-engaging member 12*b* within side rail members 14 and 15. The following discussion will serve also as the explanation for securing the other ground-engaging members 12*a*, 12*c* within the side rail members 14, 15 as the procedure and results for all three securements are identical. As shown in FIG. 3, opposing ends of ground-engaging member 12*b* are fitted flush with the edges of the respective side rail member outer legs 14*a*, 15*a*. The ground-engaging member 12*b* is then appropriately secured by welding or other method to the respective legs 14*a*, 15*a* thereby forming strong butt-joint fits. The ground-engaging member 12*b* is also secured to the inner legs 14*b*, 15*b* of the respective side rail members. As can be seen in FIG. 1, a respective portion of each inner leg must be removed in order to obtain the placement of the entire cross-sectional area of the ground-engaging member ends flush against the outer legs. The removed portion of inner legs 14*b*, 15*b* fit over and around a portion of the ground-engaging member 12*b* and the two portions are then fixedly secured to each other by welding or similar method. The resulting arrangement is a notched-fit of the ground-engaging member with the inner legs of each side rail member.

When all of the ground-engaging members 12*a*, 12*b*, 12*c* are secured within and to the side rail members 14, 15 and the side rail members are respectively attached to the scraper member 13 the completed arrangement of the members with respect to each other becomes clear in the cross-sectional view of FIG. 2. The alignment of the lower surfaces of the ground-engaging members 12*a*, 12*b*, 12*c* and scraper member 13 is maintained for effective leveling action. The sloping top surface of each side rail member provides an open area above the upper surfaces of the end portions of the ground-engaging members wherein more soil can be carried away from the forwardmost area of the apparatus without substantial sticking of the soil in the joint corners.

Figure 4:
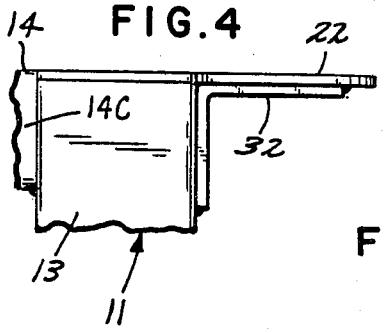
FIG. 4 is a fragmentary plan view of a portion of the embodiment shown in FIG. 1.

Attached at opposing ends of scraper member 13 is a retaining shoe member 21, 22. The shoe shape can be seen in FIG. 1 with a portion of the shoes 21, 22 projecting forward beyond member 13 in the direction of motion. To reinforce the free projecting portions of the shoes 21, 22 a right angle bracing plate 32 is provided for each shoe. FIG. 4 illustrates the positioning of the bracing plate 32 relative to member 13 and shoe 22. The positioning of an identical bracing plate relative to member 13 and shoe 21 would also be as shown in FIG. 4. The bracing plate is mounted by using any suitable method such as welding, riveting, etc.

The upstanding connecting means 20 shown in FIG. 1 is directed for attachment to a three-point hitch draft vehicle. The angled central beam 23 is generally vertical and has a lower end which is affixed to the frame 11 of the apparatus usually atop member 13. The free upper end of beam 23 is designed for attachment to the central link of a three-point hitch by a standard connection method shown at 31 in FIGS. 1, 2 and 3. Positioned proximate central beam 23 on either side are two shorter beams 24 which are generally vertical also. Each beam 24 has an end affixed to the frame 11, usually atop member 13, and has a free end constructed for attachment to the vertically adjustable lift arms of the three-point hitch. Again, standard connection means are used as designated by 31 in FIGS. 1, 2 and 3. To support the primary central beam 23, a strut or support beam 25 is provided having one end attached to a central portion of the rearward side of beam 23 and a second end attached to the top surface of the frame brace member 30 as shown in FIGS. 1 and 3. Again, any suitable beam attachment method can be used.

Figure 5:
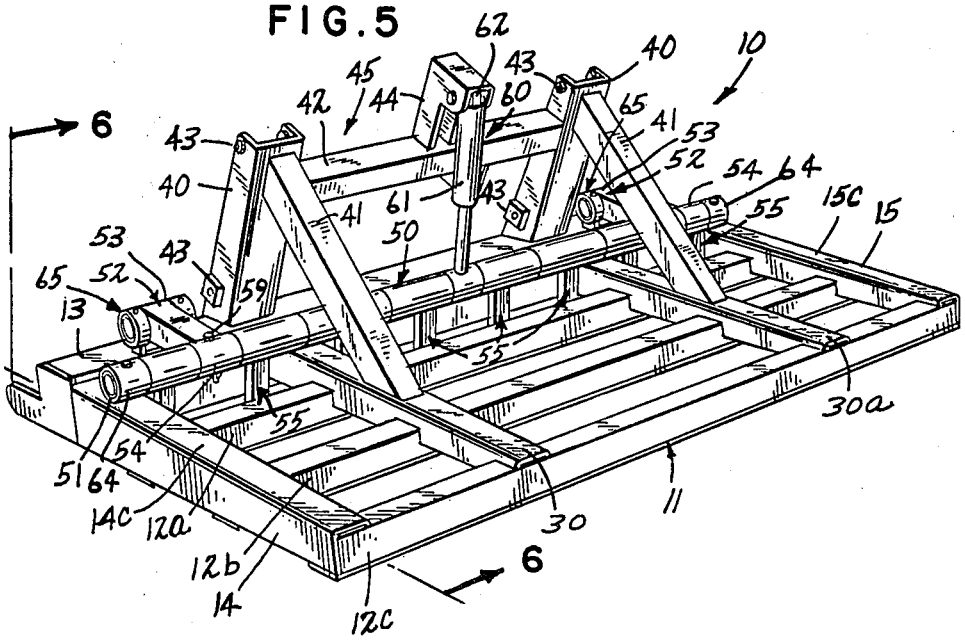
FIG. 5 is a perspective view of a second embodiment of the present invention.

The apparatus 10, as shown in FIG. 5, has a frame 11 and side rail members 14, 15 constructed in the manner discussed above for the embodiment shown in FIG. 1. The connecting means 45 in FIG. 5 is specifically constructed for attaching the apparatus 10 to a skid-steer type vehicle rather than a three-point hitch draft means. Additionally a scarifying means 50 is provided for breaking up and loosening the soil immediately prior to the leveling of the soil surface by the apparatus 10.

The connecting means 45 as shown in FIGS. 5, 6 and 7 includes two upstanding primary beams 40, slightly angled away from the skid-steer vehicle. The primary beams 40 are spaced apart and each has an end which is fixedly attached to the frame 11 generally along the top surface of scraper member 13. At the free end of each primary beam 40 and at a location proximate each beam's attachment to member 13 there are provided connectors 43 for operatively connecting the apparatus 10 to a skid-steer vehicle whereby the position of apparatus 10 can then be adjusted relative to the surface of the ground by controls located on the skid-steer vehicle. This connection is shown as pin devices in FIGS. 6 and 7. Each primary beam 40 has connected to a portion of its free end an end of a strut or support beam 41. The second end of each support beam 41 is fixedly attached to a respective frame bracing member 30, 30*a*. The support beams 41 are angled generally upward and towards the draft means. Further included in the connecting means 45 is a cross-beam 42 located intermediate the primary beams 40. The cross-beam 42 is secured at its ends to the respective primary beams 40. Positioned intermediate the beams 40 and mounted to the top surface of the cross-beam 42 is a generally vertical connector means 44 for operatively connecting a scarifying means to the cross-beam and thereby to the operating controls of the skid-steer vehicle.

The scarifying means 50 is usually positioned intermediate scraper member 13 and ground-engaging member 12*a* to achieve compact overall construction for apparatus 10; however, the scarifier means can be located ahead—instead of behind—the leading scraper member, if desired. Stated otherwise, the scarifying means 50 extends adjacent to the scraper member 13 on either side thereof, but is preferably located behind the scraper member for maximum compactness and protection from damage. The cross-shaft 51 of the scarifying means 50 lies transverse to the direction of motion. Its two free ends, having collars 64 as shown in FIG. 5, rest on respective sloping surfaces 14*c* and 15*c* of the side rail members when the scarifying means is in the operative position shown in FIG. 5.

A pair of connector arms 52 provide a means for attaching the cross-shaft to the frame 11 of the apparatus. Each connector arm 52 has a first end 53 and a second end 54. Each first end 53 has a cylindrical shape and is pivotally connected to a respective mounting bracket means 65. Means 65 are each mounted upon the top surface of scraper member 13, as shown in FIGS. 6 and 7. Each second end 54 also has a cylindrical shape and is rigidly connected by suitable connecting means, such as pins, 59 to the cross-shaft 51, as illustrated clearly in FIG. 6.

Extending downwardly from the cross-shaft 51 are several scarifiers 55. Each scarifier 55, as can be seen in FIGS. 6 and 7, has an upper end 56, a central portion 57 and a tooth portion 58. Each upper end 56 is constructed to allow the passage of the cross-shaft 51 therethrough. The circular cross section of each end 56 allows the scarifier to swing freely relative to the cross-shaft 51 while being held directly upon the cross-shaft 51. A structural advantage of the scarifiers 55 is the ability to use the swinging aspect of the assembly to position the scarifiers into a small area as shown in FIG. 5. The central portion 57 of each scarifier is generally elongated and when in operation is generally vertically disposed and contacts the ground-engaging member 12*a* as shown in FIG. 6 thereby preventing the scarifier 55 from swinging rearwardly about the cross-shaft when the scarifying means is in its operative position. The scarifiers 55 are positioned apart from each other on the cross-shaft 51 by the axial dimension of the upper ends 56. Use of differing axial dimensions for the upper ends 56 or use of spacer elements, not shown, can vary the numbers of scarifiers 55 provided on the cross shaft 51. Each spacer has a circular cross-section and thus could be removably held around the cross-shaft 51. Thus, the design of the scarifiers 55 and the spacers, not shown, allows them to be easily removed from the cross-shaft in order to vary the scarifier spacing or to replace a broken scarifier by removing collars 64 and connector arm end pins 59 and sliding the elements off the cross-shaft and inserting the necessary spacers or new scarifiers.

As illustrated, the scarifiers 55 are individually pivoted to cross-shaft 51; however, it will be appreciated that the scarifiers can be rigidly connected to the cross-shaft with the cross-shaft being rotatably supported by the cylindrical ends 54 of the connector arms 52. Pins 59 could thus be eliminated in this alternate approach, which is considered the full equivalent of the disclosed scarifier mounting.

In some applications, it may be desirable to interconnect the cross-shaft 51, connector arms 52 and scarifiers 55 as a rigid unit which can be selectively raised and lowered as such. This, too, is considered the full equivalent of the scarifier mounting herein.

In addition, although the ground-engaging member 12*a* serves as the common back stop for scarifiers 55, it will be understood that individual stops associated with the scarifiers could be provided on frame 11 or on the scarifying means 50. Of course, if the scarifying means 50 is positioned in front of frame 11, the scraper member 13 could serve as the back stop for scarifiers 55.

An actuating means 60 can alternately lower the scarifying means 50 into an operative position and raise it into an inoperative position. The actuating means 60 includes a standard hydraulic cylinder 61, a lower end 63 engaging the cross-shaft 51 as seen in FIG. 5 and an upper end 62 which is connected in any standard manner to vertical member 44 as shown in FIGS. 5 and 6. In place of hydraulic cylinder 61, a pneumatic cylinder, motor and drive, a manual linkage can be included in the actuating means 60 for selectively controlling position of the scarifying means 50.

Figure 8:
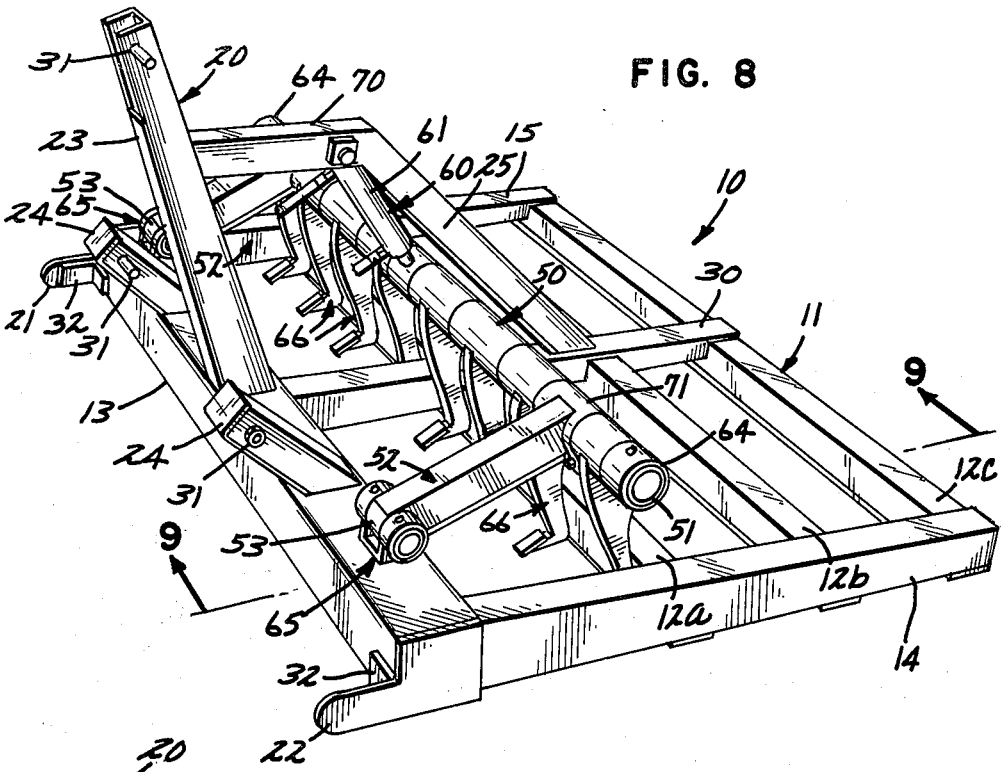
FIG. 8 is a perspective view of a third embodiment of the present invention.
Figure 9:
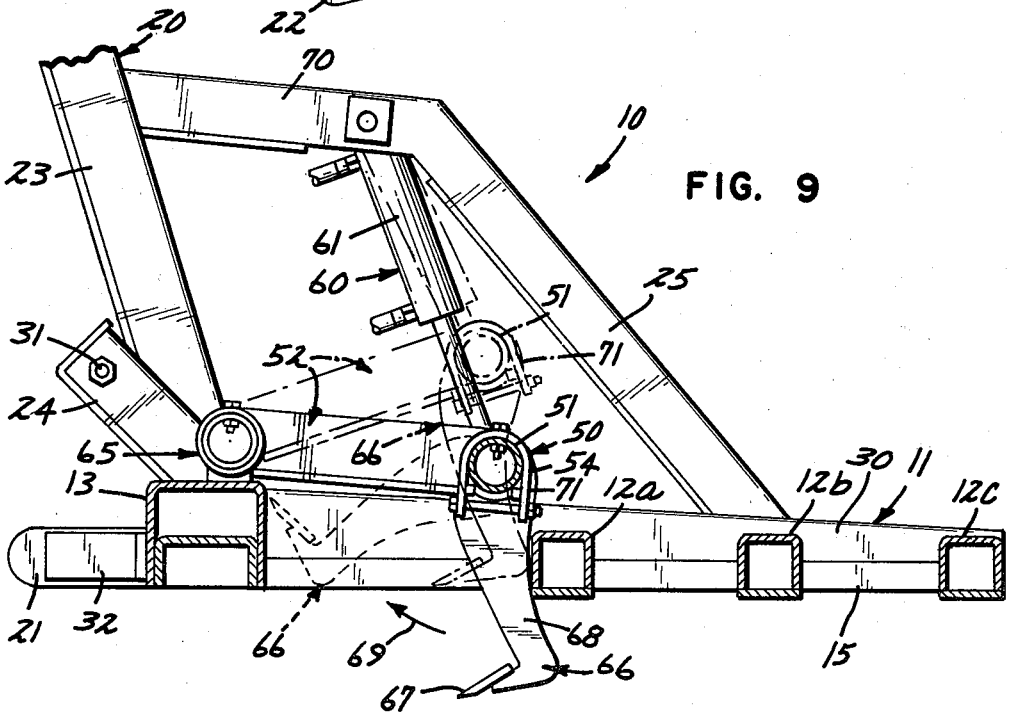
FIG. 9 is a cross-sectional view of the embodiment shown in FIG. 8 as seen along line 9—9 in FIG. 8.

FIGS. 8 and 9 illustrate a soil levelling apparatus 10 incorporating a third embodiment of the invention. The third embodiment of apparatus 10 includes a frame 11, scraper member 13, and side rail members 14 and 15 constructed similarly to the first embodiment of the apparatus shown in FIGS. 1–4. For ease of identification, the same reference numerals have been utilized for corresponding parts or elements between these embodiments.

The primary distinction between the third embodiment of apparatus 10 shown in FIGS. 8 and 9 and those shown in FIGS. 1–7 comprises the fact that the scarifying means 50 utilizes scarifiers 66 which are configured to maintain a substantially constant angular orientation with respect to the underlying soil independent of the vertical position thereof. In particular, as is best seen in FIG. 9, each scarifier 66 has a tooth portion 67 secured to the lower end of a central portion or shank 68. The shanks 68 of scarifiers 66, and particularly the rear edge or back portions of the shanks, are curved and adapted for cooperation with the immediately following fixed transverse ground-engaging member 12*a* so that the scarifiers occupy a substantially constant angular relationship regardless of the vertical position of the scarifying means 50. The shanks 68 of scarifiers 66 are thus formed to act as self-camming members in cooperation with member 12*a* during actuation of the scarifying means 50 by cylinder 61 between the full down position shown in solid lines in FIG. 9 and the full up position shown in phantom lines therein. This is advantageous because it assures that the scarifying teeth 67 will be oriented in the desired optimum position for breaking up and loosening the soil regardless of their penetration depth. Those skilled in the art will appreciate the fact that different soil conditions may require different orientations of the scarifying teeth 67. The curved shanks 68 of scarifiers 66 permit maintenance of the appropriate tooth angle over the full range of depth penetration.

Another aspect of the inventive embodiment shown in FIGS. 8 and 9 involves the fact that the forwardmost cross member 13 and the next intermediate cross member 12*a* are longitudinally spaced apart a sufficient distance to permit forward pivotal movement of scarifiers 66 in the direction of arrow 69 to the position indicated with dashed lines in FIG. 9 out of engagement with the soil. This feature permits the unit to be reversed or backed up without first requiring lifting of the apparatus, which in turn saves time. The scarifying means 50 of the third embodiment is thus positioned slightly more rearward than that shown in the second embodiment of FIGS. 5–7, as a consequence of which the slightly longer connector arms 52 are utilized as is another support strut 70 for interconnecting the first strut 25 with post 23.

One other feature of the embodiment of FIGS. 8 and 9 is the use of U-shaped clamps 71 for stiffening the connection between arms 52 and cross-shaft 51 against skewing. The use of clamps 71, one of which is seen in FIG. 8, lends rigidity to the scarifying means 50 so that scarifiers 66 remain level during lifting and lowering. Clamps 71 are ridigly secured to the ends of connector arms 52, such as by welding, and are secured to the cross-shaft 51 by bolts as shown.

Operation of the Preferred Embodiment

Operation of the apparatus 10 is effected through the control means of whichever type of draft vehicle is used, which is usually either a three-point hitch vehicle or a skid-steer vehicle. Use of such vehicles provides the source of power required to vary the angle at which the apparatus is held relative to the surface of the soil. The ability to vary the apparatus's operating angles allows the operator to level a particular surface more accurately and efficiently, with varying quantities of soil being accommodated by the apparatus.

The important aspects in the operation of the present invention are the advantages resulting from the use of continuous channel, side rail members rather than using rectangular tubing with individual side plates or other prior art arrangements. The continuous side rail members 14, 15 prevent soil from escaping outward from the sides of the apparatus 10 and thereby prevents formation of ridges along the leveled surface. The bottom edge of each side rail member outer leg 14*a*, 15*a* acts as a skid to allow the apparatus to ride over an obstruction such as a tree root. This eliminates any "catching" of the apparatus by the obstruction and thereby significantly eliminates the problems of side plates being bent by such obstructions as rocks, buried objects, etc.

The open design as discussed earlier which results from the sloping upper surfaces 14*c*, 15*c*, the butt-joint and the notched-fit securements of the ground-engaging members 12*a*, 12*b*, 12*c* within side rail members 14, 15 greatly lessens soil spillage over the top surface of the side rail members. This open design allows more soil to be carried in the corners of the fittings by the outer legs 14*a*, 15*a* as well as lessening the amount of soil sticking in the joint corners because of the soil flow permitted within and along the side rail members 14, 15 and over the ground-engaging member ends.

The continuous length and vertical depth of the side rail members 14, 15 provide greater strength to the apparatus than is provided by individual side plates. Further, the sloping upper surface of each side rail member provides an increased cross-sectional area for attaching the side rail member 14, 15 to the scraper member 13. This increase in contact area provides an additional source of frame strength.

The cost of manufacture of the preferred embodiment will be less because of the smaller number of pieces involved in the fabrication process. Overall there is a better machine appearance with a continuous side rail construction. And, finally, the use of single retaining shoes at the forwardmost end of the apparatus provides the necessary structure for allowing only small amounts of soil to escape incrementally around the edge of the shoe without greatly affecting the leveling objective.

The scarifying assembly 50 has basically two operational aspects. In its raised position, as shown by the dotted lines in FIG. 6, the scarifying assembly 50 is in an inoperative position with the scarifiers 55 disengaged from the soil. The operative position of the scarifying assembly results when the hydraulic cylinder 61 lowers the assembly 50 to a position where the ends of the cross-shaft 51 rest upon the upper rail surfaces 14*c*, 15*c* and the tooth portions 58 of the scarifiers 55 enter into the soil. The cross-shaft 51, scarifiers 55, and connector arms 52 pivot from an operative to an inoperative position about the bracket means 65. The pinning connection 59 between the connector arm ends 54 and the cross-shaft 51 as seen in FIG. 6 substantially lessens the amount of twisting the scarifying assembly 50 undergoes as it is being raised.

As the apparatus 10 moves forward the engaged scarifiers 55 loosen up compacted soil areas and break up any individual chunks of soil in order to provide a soil consistency which can then be better leveled by the apparatus. The scarifiers traveling through the soil will be forced rearward causing strain upon both the cross-shaft and the hydraulic cylinder rod. The strain is lessened considerably by positioning the assembly within the frame whereby the scarifiers when forced rearward contact the front surface of ground-engaging member 12*a* as discussed above. And the cylinder strain is further lessened and the soil depth of the scarifiers controlled as the cross-shaft 51 rests upon the top surfaces 14*c*, 15*c* of the apparatus 10.

The scarifying assembly 50 incorporating scarifiers 66 operates in substantially the same manner, but with the added advantages of substantially constant angular orientation regardless of penetration depth together with the capability of being able to pivot forward completely out of engagement with the soil upon reversal as discussed hereinabove.

Although particular embodiments of the invention have been illustrated in the accompanying Drawings and described in the foregoing Detailed Description, it will be understood that the invention is not limited to the embodiments disclosed, but is capable of numerous rearrangements, modifications, and the substitutions of parts and/or elements without departing from the scope of the invention as defined by the following claims.

I claim:

1. An apparatus for leveling soil and the like, comprising:

a generally rectangular frame including a leading transverse, elongate scraper member and a plurality of trailing transverse elongate ground-engaging members fixedly secured in mutually spaced-apart relationship between a pair of longitudinal side members and at least one longitudinal intermediate member;

the scraper member including a lower edge and each ground-engaging member including a lower surface, with the lower edge of the scraper member and the lower surfaces of the ground-engaging members of said frame being substantially co-planar;

means mounted on said frame for releasably connecting the apparatus to a draft means;

a plurality of scarifiers depending in mutually spaced apart relationship adjacent to the scraper member of said frame;

means for supporting said scarifiers on said frame for pivotal movement between forward and rearward positions, the scraper member and adjacent ground-engaging member of said frame being spaced apart sufficiently to permit forward pivoting of said scarifiers out of ground engagement upon reversal of the apparatus;

means for supporting said scarifiers for vertical movement between raised and lowered positions;

means associated with said scarifiers for controlling pivotal orientation of said scarifiers in the rearward positions during vertical positioning thereof; and means connected to said support means for selectively adjusting vertical positioning and thus penetration depth of said scarifiers relative to the soil between the raised and lowered positions.

2. The apparatus of claim 1, wherein the scraper member of said frame is of generally inverted channel construction comprising an inside channel section nested within and secured to an outside channel section.

3. The apparatus of claim 1, wherein said ground-engaging members of said frame are of generally tubular construction, being of rectangular cross-section and substantially uniform size.

4. The apparatus of claim 1, wherein each side member of said frame comprises a channel section having a top surface sloping downwardly away from said scraper member, a generally vertical inner leg notched to receive the ground-engaging frame members, and a relatively longer vertical outer leg having a lower edge which is substantially co-planar with the lower edge and surfaces of the scraper and ground-engaging members of said frame.

5. The apparatus of claim 1, wherein each intermediate member of said frame comprises a channel section having a top surface sloping downwardly away from the scraper member and a pair of generally vertical spaced-apart legs notched to receive the ground-engaging members of said frame.

6. The apparatus of claim 1, wherein said connecting means comprises:

an upstanding post secured to said frame;

a pair of relatively shorter lugs secured to said frame on opposite sides of said post, said post and lugs being adapted for connection to a three point hitch mechanism; and a brace secured between said post and frame.

7. The apparatus of claim 1, further including:

a pair of forwardly extending vertical plates secured to opposite ends of the scraper member of said frame to prevent soil from escaping around the sides thereof.

8. Apparatus for leveling soil and the like, which comprises:

a generally rectangular frame including a transverse elongate scraper member followed by at least one transverse elongate ground-engaging member secured in mutually spaced-apart relationship between a pair of longitudinal side members, the scraper member including a lower edge and each ground-engaging member including a lower surface with the lower edge of the scraper member and the lower surface of the ground-engaging member of said frame being substantially co-planar;

means secured to said frame for releasably connecting the apparatus to a draft means;

a cross shaft extending above and adjacent to the scraper member of said frame;

means for mounting said cross shaft on said frame for vertical movement between raised and lowered positions;

a plurality of depending scarifiers mounted at intervals along said cross shaft for pivotal movement between forward and rearward positions;

stop means associated with said scarifiers for defining the rearward positions thereof, each scarifier having a predetermined arcuate camming portion thereon adapted for engagement with said stop means whereby said scarifiers maintain substantially constant orientation in the rearward position during lifting and lowering of said cross shaft; and means connected to said mounting means for selectively adjusting vertical positioning of said scarifiers in accordance with the desired soil penetration.

9. The apparatus of claim 8, wherein the scraper member of said frame is of generally inverted channel construction comprising an inside inverted channel section nested within and secured to an outside inverted channel section.

10. The apparatus of claim 8, wherein said ground-engaging members of said frame are of generally tubular construction, being of rectangular cross-section.

11. The apparatus of claim 8, wherein each side member of said frame comprises a channel section having a top surface sloping downwardly away from said scraper member, a generally vertical inner leg notched to receive the ground-engaging frame members, and a relatively longer vertical outer leg having a lower edge which is substantially co-planar with the lower edge and surface of the scraper and ground-engaging members of said frame.

12. The apparatus of claim 8, wherein said connecting means comprises:

an upstanding post secured to said frame;

a pair of relatively shorter lugs secured to said frame on opposite sides of said post, said post and lugs being adapted for connection to a three point hitch mechanism; and a diagonal brace secured between said post and frame.

13. The apparatus of claim 8, wherein said cross-shaft is disposed between the scraper member and adjacent ground-engaging member of said frame, and wherein the scraper member and adjacent ground-engaging member of said frame are spaced apart sufficiently to permit free forward pivotal movement of said scarifiers out of ground engagement upon reversal of the apparatus.

14. The apparatus of claim 8, further including:

a pair of forwardly extending vertical plates secured to opposite ends of the scraper member of said frame to prevent soil from escaping around the sides thereof.

15. The apparatus of claim 8, wherein said scarifiers are individually pivoted to said cross-shaft.

16. Apparatus for leveling soil and the like, which comprises:

a frame including a transverse elongate scraper member followed by a plurality of transverse elongate ground-engaging members secured in mutually spaced-apart parallel relationship between a pair of longitudinal side members and at least one longitudinal intermediate member;

the scraper and portions of the side members including lower edges, and the ground-engaging members including lower surfaces, with the lower edges and surfaces of the scraper, ground-engaging, and portions of the side members of said frame lying in a common plane;

means secured to said frame for connecting the apparatus to a draft means;

a cross shaft extending above and between the scraper member and adjacent the ground-engaging member of said frame;

a plurality of depending scarifiers pivoted at intervals along said cross shaft for movement between forward and rearward positions, the scraper member and adjacent ground-engaging member of said frame being spaced apart sufficiently to permit free forward pivotal movement of said scarifiers out of ground engagement upon reversal of the apparatus;

means for adjustably supporting said cross shaft and scarifiers for selective vertical positioning between raised and lowered positions relative to the soil; and means associated with said scarifiers for controlling pivotal orientation of said scarifiers in the rearward positions during vertical positioning of said scarifiers.

17. The apparatus of claim 16, wherein said connecting means comprises:

an upstanding post secured to said frame;

a pair of relatively shorter lugs secured to said frame on opposide sides of said post, said post and lugs being adapted for connection to a three point hitch mechanism; and a diagonal, longitudinally extending brace secured between said post and frame.

18. The apparatus of claim 16, wherein the scraper member of said frame is of generally inverted channel construction and wherein the ground-engaging members are of generally tubular construction.

19. The apparatus of claim 16, further including:

a pair of vertical plates secured to opposite ends of the scraper member of said frame to prevent soil from escaping around the sides of the apparatus.

20. Apparatus for leveling soil and the like, which comprises:

a generally rectangular frame including a leading transverse elongate scraper member with a lower edge followed by a plurality of trailing transverse elongate ground-engaging members with lower surfaces secured in parallel, mutually spaced-apart relationship between a pair of longitudinal side members, the lower edge and surfaces of the scraper and ground-engaging members of said frame being substantially co-planar;

the scraper member of said frame being of generally inverted channel construction and the ground-engaging members being of generally tubular construction;

means secured to said frame for releasably hitching the apparatus to a draft means;

a cross shaft disposed above and between the scraper member and adjacent ground-engaging member of said frame;

means mounted on said frame for supporting said cross shaft for vertical movement between raised and lowered positions;

a plurality of depending scarifiers pivoted at intervals along said cross shaft for pivotal movement between forward and rearward positions;

means including a predetermined arcuate camming portion on each scarifier adapted for engagement with the adjacent ground-engaging member in the rearward positions for controlling pivotal orientation of said scarifiers during vertical movement of said cross-shaft;

the scraper member and adjacent ground-engaging member of said frame being longitudinally spaced apart a sufficient distance to permit free forward pivotal movement of said scarifiers out of ground engagement upon reversal of the apparatus; and means connected to said support means for selectively positioning said cross shaft and scarifiers in vertical positions between the raised and lowered positions.

* * * * *